US005891321A

United States Patent [19]

Bernhardt

[11] Patent Number: 5,891,321

[45] Date of Patent: Apr. 6, 1999

[54] ELECTROCHEMICAL SHARPENING OF FIELD EMISSION TIPS

[75] Inventor: Anthony F. Bernhardt, Berkeley, Calif.

[73] Assignee: The Regents of the University of California, Oakland, Calif.

[21] Appl. No.: 847,087

[22] Filed: May 1, 1997

[51] Int. Cl.[6] ..... C25F 3/14

[52] U.S. Cl. ..... 205/664; 205/674; 445/35; 445/50

[58] Field of Search ..... 204/4, 20; 205/122, 205/123; 445/24, 27, 50; 313/309

[56] References Cited

U.S. PATENT DOCUMENTS

| | | | |
|---|---|---|---|
| 5,462,467 | 10/1995 | Macaulay et al. | 445/50 |
| 5,559,389 | 9/1996 | Spindt et al. | 313/310 |
| 5,562,516 | 10/1996 | Spindt et al. | 445/24 |

OTHER PUBLICATIONS

Allan J. Melmed, "The art and science and other aspects of making sharp tips";American Vacuum Society; Journal of Vacuum Science Technology; B; vol. 9, No. 2; pp. 601–608, Apr. 1991.

Busta H. Heinz, "Vacuum Microelectronics—1992 Review"; Journal of Micromechanical Microeng; vol. 2; pp. 43–74, Jun. 1992.

J.K. Cochran et al, "Low–voltage field emission from tungsten fiber arrays in a stabilized zirconia matrix"; Journal of Material Research; vol. 2, No. 3; pp. 322–325, Mar. 1987.

*Primary Examiner*—Kathryn Gorgos
*Assistant Examiner*—Erica Smith-Hicks
*Attorney, Agent, or Firm*—L. E. Carnahan

[57] ABSTRACT

A method for sharpening field emitter tips by electroetching/polishing. In gated field emitters, it is very important to initiate electron emission at the lowest possible voltage and thus the composition of the emitter and the gate, as well as the emitter-gate structure, are important factors. This method of sharpening the emitter tips uses the grid as a counter electrode in electroetching of the emitters, which can produce extremely sharp emitter tips as well as remove asperities and other imperfections in the emitters, each in relation to the specific grid hole in which it resides. This has the effect of making emission more uniform among the emitters as well as lowering the turn-on voltage.

12 Claims, 1 Drawing Sheet

ELECTROCHEMICAL SHARPENING OF FIELD EMISSION TIPS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to field emitters, particularly gated field emitters for flat panel displays and vacuum microelectrics, and more particularly to electrochemical sharpening of field emission tips.

Flat panel displays and vacuum microelectronics utilize gated field emitters, and it is very important to initiate electron emission at the lowest possible voltage. Both the materials of the emitter and the gate, as well as the geometry of the emitter-gate structure, are very important in this regard. By forming an extremely sharp (needle-like) emitter tip and a correctly configured grid (gate) hole in which the emitter resides, emission is more uniform among the emitters and the turn-on voltage, which initiates electron emission, is lowered. Thus, there is a need for forming field emitters with sharp tips or for sharpening tips of previously formed field emitters.

The present invention is directed to sharpening of previously formed field emitter (nanofilament type) tips, wherein tip sharpening is carried out by electroetching/polishing using the grid (gate) of the field emission structure, such as a field emission triode structure, as a counter electrode. Electroetching performed in this way can produce extremely sharp emitter tips as well as removing asperities and other imperfections in the emitters, each in relation to the specific grid (gate) hole in which it resides.

SUMMARY OF THE INVENTION

It is an object of the present invention to provide a method for sharpening field emitter tips.

A further object of the invention is to provide field emitter tip sharpening by electroetching/polishing.

Another object of the invention is to provide electrochemical sharpening of field emission tips using the grid of the structure as a counter electrode.

Another object of the invention is to use the grid of a field emission structure as a counter-electrode in electrochemical sharpening and homogenization of field emitters in a field emission triode structure, for example.

Other objects and advantages of the present invention will become apparent from the following description and accompanying drawings. The invention involves a method for sharpening tips of field emitters. The method uses the grid of a field emission structure as a counter-electrode in electrochemically sharpening and homogenization of the field emitters of the structure. The field which is established for polishing the tip is similar in form to the field which exists in actual field emission. Polishing of the tip will preferentially etch points on the emitter nearest the grid or gate so the tip will sharpen. The grid can also be deburred and polished (e.g. prior to tip sharpening) by using the opposite polarity.

Thus, for example, if the grid hole is not perfectly round but has a protrusion, that protrusion will be preferentially etched. As a result of the electroetching/polishing method of this invention the ultimate field emission will be more uniform and reproducible from tip to tip and panel to panel.

BRIEF DESCRIPTION OF THE DRAWINGS

The accompanying drawings, which are incorporated into and form a part of the disclosure, illustrate an embodiment utilizing the method of the invention and, together with the description, serve to explain the principles of the invention.

DETAILED DESCRIPTION OF THE INVENTION

Figure 1:
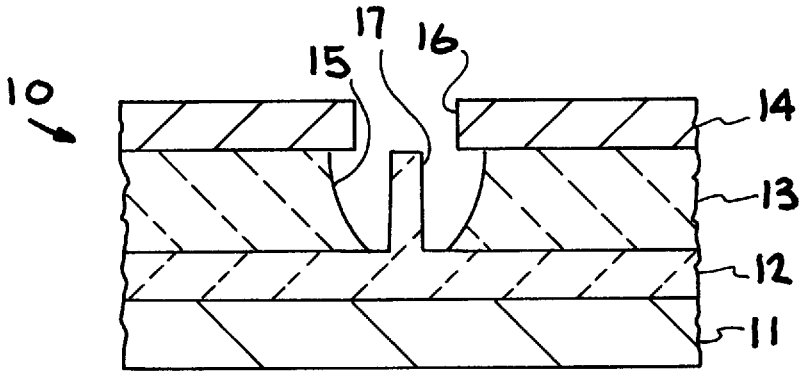
FIG. 1 illustrates in cross-section an embodiment of a gated field emitter.

The invention is directed to field emitter tip sharpening by electroetching/polishing. The invention utilizes the grid of a gated field emitter structure as a counter electrode in the electroetching of the emitters. Electroetching, using the field emitter structure grid as an electrode, produces extremely sharp emitter tips as well as removes asperities and other imperfections in the emitters, each in relation to the specific grid hole in which it resides. By reversing the polarity, and prior to the electroetching/polishing of the emitters, the grid can be deburred and polished to produce, for example, a perfectly round hole therein. As the result of the electroetching/polishing method of this invention, the ultimate field emission should be much more uniform and reproducible from tip to tip and panel to panel.

The present invention is particularly applicable in gated field emitters for flat panel displays, for example, where initiation or turn-on of electron emission is at the lowest possible voltage. Thus, both the materials of the emitter and the gate and the geometry of the emitter-gate structure are very important. Also, the emitter-gate structure formed by the present invention can be used in vacuum microelectronics for radiation hard performance and in ultrasensitive chemical sensors.

The electroetching/polishing method of the present invention is broadly described hereinafter with respect to FIGS. 1–3, which illustrate an embodiment of a section of a gated field emitter structure generally indicated at 10 comprising a row metal layer 11, a resistor layer 12, a dielectric layer 13, and a metal gate or grid layer 14, with the layers 13 and 14 having vias or openings 15 and 16, respectively, and a field emitter 17 located in dielectric opening 15 and integral with or electroplated to resistor layer 12. By way of example, the row metal layer 11 may be composed of nickel, chromium, or copper with a thickness of 200 to 300 nm; the resistor layer 12 may be composed of silicon carbide, amorphous silicon or a cermet with a thickness of 200 to 300 nm; the dielectric layer 13 may be composed of $SiO_2$, Cr—Si—O or other cermet with a thickness of 200 to 300 nm; and the gate or grid layer 14 may be composed of chromium or molybdenum with a thickness of 40 to 300 nm; with the opening 16 having a diameter of 30 to 300 nm; and the field emitter having cross-section of 20 to 200 nm and a height equal to or slightly greater than the thickness of the dielectric layer, and composed of nickel, copper, or platinum, which may or may not be of the same composition as row metal layer 11.

Figure 2:
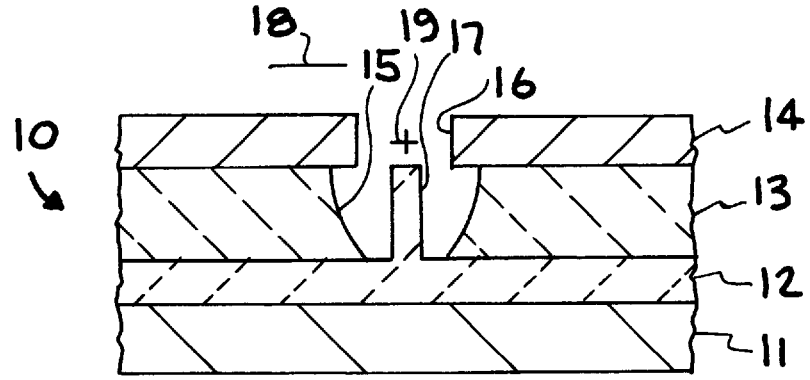
FIG. 2 illustrates gated field emitter of FIG. 1 with the electrical potentials as applied to sharpen the tip of the emitter in accordance with the present invention.

FIG. 2 illustrates the structure of FIG. 1 and indicates the electric potentials for electroetching/polishing the field emitter 17. In this embodiment the grid or gate layer 14 is at a negative potential as indicated at 18, and the field emitter 17 is at a positive potential as indicated at 19. With the grid or gate layer 14 acting as a counter electrode and with the electric field established during etching/polishing being the same as exists in actual field emission, the etching/polishing will preferentially etch the corners of the emitter 17 nearest the grid 14 so that the tip of the emitter will sharpen.

Figure 3:
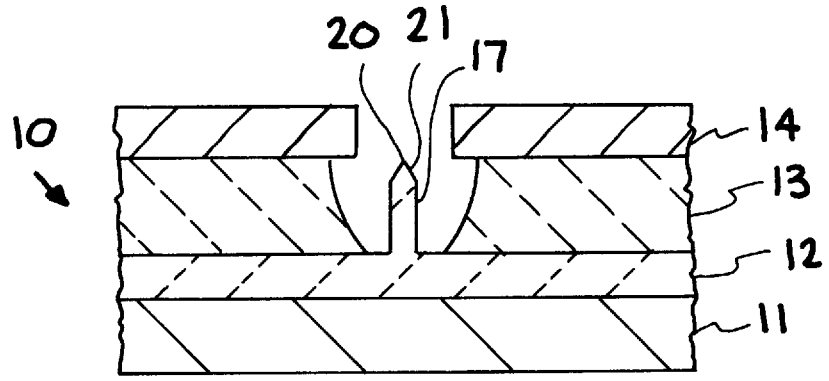
FIG. 3 illustrates the gated field emitter of FIG. 1 with a sharp field emitter tip produced in accordance with the invention.

The electroetching/polishing method, as described in detail hereinafter, is carried out to produce a point 20 on a tapering tip 21 of field emitter 17 of the structure 10, as illustrated in FIG. 3. While not shown, the electroetching/polishing method additionally enables the removal of asperities and other imperfections of the field emitter 17. Should, for example, the via or opening 16 in the grid or gate layer 14 need be deburred, for example, having protrusion therein by reversing to polarity illustrated in FIG. 2, that protrusion will be preferentially etched, leaving the opening 16 a perfectly round configuration.

A specific example of the electroetching/polishing method of this invention is described in detail as follows:

1. Providing a gated field emitter as illustrated in FIG. 1, for example.
2. Applying a positive potential 19 to the emitter 17 and a negative potential 18 to the grid 14, is indicated in FIG. 2, with the positive potential being in a range of 0.2–2.0 volts and the negative potential being at 0 volts. A conventional power supply, such as model BOP 20—20, manufactured by Kepco, with the above-exemplified applied voltages, for a time period about 0.01–10.0 ms, can be used to sharpen a nickel emitter in a solution of dilute sulfuric acid. Also, a solution using phosphoric or hydrochloric acid can be used.

Should the opening 16 in gate or grid 14 have a protrusion that need be deburred, and with the gate or grid composed of chromium, reversal of the polarities as shown in FIG. 2, with a positive voltage applied to grid 14 and a negative voltage of 0.2 to 2.0 volts applied to emitter 17, a grid can be preferentially etched.

It has thus been shown that the present invention provides field emitter tip sharpening and homogenization by electroetching/polishing, which is carried out using the grid as a counter electrode. By reversal of the potential, the grid can be deburred and polished. As the result of this method, the ultimate field emission will be much more uniform, have a lower turn-on voltage, and reproducible from tip to tip and panel to panel.

While a particular embodiment and a particular operation sequence, materials, and parameters, etc., have been described and/or illustrated to exemplify and explain the principles of the invention, such are not intended to be limiting. Modifications and changes may become apparent to those skilled in the art, and it is intended that the invention be limited only by the scope of the appended claims.

The invention claimed is:

1. A method for sharpening gated field emitter tips, comprising:

using the grid of the gated field emitter as a counter electrode, applying an electric potential in the range of 0.2 to 2.0 volts across the field emitter, causing the tip of the emitter to be etched.

2. The method of claim 1, wherein the potential is applied in a solution selected from the group consisting of sulfuric acid, phosphoric acid, and hydrochloric acid.

3. The method of claim 1, wherein the applied potential is controlled to shape the configuration of the emitter tip.

4. The method of claim 1, additionally including deburring of the grid by reversal of the potential applied across the emitter.

5. The method of claim 1, additionally including forming the gated field emitter by:

providing a layer of row metal, forming a resistor layer on the layer of row metal, forming a layer of dielectric material on the resistor layer, forming at least a grid layer on the layer of dielectric material, forming an opening in the grid layer and in the dielectric layer, and forming by electroplating an emitter on the resistor layer in the opening in the grid and dielectric layers, using the grid layer as a counter electrode.

6. In a method for fabricating gated field emitters for use in flat panel displays and vacuum microelectronics, the improvement comprising:

sharpening the tip of the field emitters by electroetching/polishing using an applied potential range from about 0.2 volts to about 2.0 volts and the grid of the gated field emitters as a counter electrode.

7. The improvement of claim 6, wherein the electroetching/polishing is carried out in a controlled atmosphere.

8. The improvement of claim 6, wherein the electroetching/polishing is carried out with a negative potential on the grid and a positive potential on the emitters.

9. The improvement of claim 8, additionally including controlling the applied potential for controlling the shape of the emitter tip.

10. In the method of claim 6, the improvement additionally comprising:

prior to sharpening the tip of the field emitters, reversing the polarity and etching/polishing holes in the grid in which the emitters are located.

11. The improvement of claim 10, wherein etching/polishing of the grid holes is carried out with a positive potential on the grid and a negative potential on the emitter.

12. The improvement of claim 6, wherein the electroetching/polishing is carried out by controlling the potential applied to at least the grid for controlling the shape of the tips of the emitters.

* * * * *